US011998092B2

(12) United States Patent
Luo

(10) Patent No.: US 11,998,092 B2
(45) Date of Patent: Jun. 4, 2024

(54) ROTARY REPLACEABLE UMBRELLA NEST ASSEMBLY FOR AN UMBRELLA

(71) Applicant: Tempo Manufacturing LLC, Nantong (CN)

(72) Inventor: Xiong Luo, Nantong (CN)

(73) Assignee: Tempo Manufacturing LLC, Nantong (CN)

( * ) Notice: Subject to any disclaimer, the term of this patent is extended or adjusted under 35 U.S.C. 154(b) by 185 days.

(21) Appl. No.: 17/811,439

(22) Filed: Jul. 8, 2022

(65) Prior Publication Data

US 2023/0016660 A1 Jan. 19, 2023

(30) Foreign Application Priority Data

Jul. 19, 2021 (CN) ..... 202110811050.8

(51) Int. Cl.
*A45B 25/06* (2006.01)
*A45B 23/00* (2006.01)
*A45B 25/08* (2006.01)

(52) U.S. Cl.
CPC ..... *A45B 25/08* (2013.01); *A45B 23/00* (2013.01)

(58) Field of Classification Search
CPC ..... A45B 25/06; A45B 25/08
USPC ..... 135/28
See application file for complete search history.

(56) References Cited

U.S. PATENT DOCUMENTS 648,245 A * 4/1900 Deweese ..... A45B 25/06 135/30
710,427 A * 10/1902 Climenson et al. ... A45B 25/06 135/30
847,805 A * 3/1907 McAvoy ..... A45B 25/06 135/30
1,373,642 A * 4/1921 Walter ..... A45B 25/10 135/48

* cited by examiner

*Primary Examiner* — Noah Chandler Hawk
(74) *Attorney, Agent, or Firm* — Wang Law Firm, Inc.

(57) ABSTRACT

A rotary replaceable umbrella nest assembly for an umbrella has a lower nest cover with a plurality of recesses for receiving the end of each rod; a circular hole is at the center of the lower nest cover for receiving a middle column; a connecting sleeve extends down from the circular hole; the connecting sleeve has a plurality of external threads; a nest support has a ring-shape matching a bottom of the lower nest cover having a center hole for a connecting sleeve to pass through; a lower nest base ornament is disposed below the nest support and is threaded with and is detachably connected to the lower nest cover.

4 Claims, 4 Drawing Sheets

ROTARY REPLACEABLE UMBRELLA NEST ASSEMBLY FOR AN UMBRELLA

TECHNICAL FIELD OF THE INVENTION

The present invention belongs to the technical field of outdoor umbrellas and relates to a nest structure, in particular to a rotary replaceable umbrella nest assembly for an umbrella.

BACKGROUND OF THE INVENTION

As an outdoor leisure appliance, umbrellas are widely used in squares, beaches, parks, courtyards and other leisure places to shade people from the sun, wind and rain. An umbrella usually comprises a nest, a middle column, rods and a piece of fabric. The nest is a key component configured to connect the rods and to unfold or fold the fabric. The existing umbrellas have a variety of nest assembly structures, but most of them are to connect upper and lower plastic components by screws, which is unaesthetic due to exposing screw mounting holes. Moreover, an ornament cannot be replaced with one of other ornaments in the same state.

Therefore, it is necessary to design a new nest structure, which is aesthetic and also easy to replace various types of ornaments.

SUMMARY OF THE INVENTION

It is an object of the present invention to provide a rotary replaceable umbrella nest assembly for an umbrella which is simple and reasonable in structure and easy and quick to replace.

For achieving the object, the rotary replaceable umbrella nest assembly for an umbrella, the umbrella comprising a middle column and a plurality of rods each having an end; the umbrella nest assembly comprising:

- a lower nest cover; a nest support disposed below the lower nest cover; and a lower nest base ornament disposed below the nest support; wherein, the lower nest cover has a plurality of recesses for receiving the end of each rod, the lower nest cover has a circular hole at the center of the lower nest cover for receiving the middle column; a connecting sleeve having a lower end extending down from the circular hole, and the connecting sleeve has a plurality of external threads on a lower end of the connecting sleeve;
- the nest support has a ring-shape matching with a bottom of the lower nest cover, the nest support has a center hole for the connecting sleeve to pass through, the nest support is connected to the bottom surface of the lower nest cover surrounding the connecting sleeve;
- the lower nest base ornament has an internal threaded hole matching with the external threads on the connecting sleeve, the lower nest base ornament is threaded to the lower nest cover such that the lower nest base ornament is detachably connected to the lower nest cover.

Preferably, the lower nest base ornament has a cone shape with a large upper end and a small lower end, the lower nest base ornament has a through hole at the center of the lower nest base ornament; a guide cylinder for receiving the middle column is connected to the lower nest base ornament; the guide cylinder has a plurality of internal threads on an inner wall at an upper end of the guide cylinder matching to the external threads of the connecting sleeve of the lower nest cover; and the connecting sleeve of the upper nest cover is in threaded to the lower nest base ornament after passing through the center hole of the nest support.

Preferably, an outer edge of the nest support corresponding to the recesses of the lower nest cover has a plurality of hollowed-out portions, and both sides of each hollowed-out portion has a plurality of position pieces inserted in the lower nest cover.

Preferably, the lower nest cover has a plurality of stop flanges facing down at a lower edge of the lower nest cover, and an outer diameter of the nest support is matched with an inner diameter of the stop flanges; the nest support has a plurality of connecting holes disposed circumferentially and at intervals; the lower nest cover has a plurality of connecting bars corresponding to the connecting holes at the lower end of the lower nest cover, and the nest support and the lower nest cover are closed up with each other and fixedly connected by the screws.

Preferably, the lower nest base ornament has an outer diameter that is the same as the lower nest cover; the lower nest base ornament has a plurality of annular grooves corresponding to the stop flanges of the lower nest cover at an upper edge of the lower nest base ornament; when the lower nest base ornament is threaded to the lower nest cover, the stop flanges of the lower nest cover fits into the annular grooves of the lower nest base ornament.

Finally, the nest support is made of metal, and the lower nest base ornament is made of plastic.

Compared with the prior art, the present invention has the following advantages. The nest support is a bearing carrier which serves as the lower nest base of traditional nests, and the lower nest base ornament does not need strength and can be replaced as needed. The screws connecting the nest support and the lower nest cover are concealed, allowing more aesthetic and reasonable appearance. The lower nest base ornament is connected to the lower nest through a plurality of internal threads for easy replacement. According to the present invention, the nest is simple and reasonable in structure and easy and quick to replace the lower nest base ornament and can meet the requirements of replacing various types of exterior parts.

DETAILED DESCRIPTION OF THE INVENTION

The present invention will be further described in detail by embodiments with reference to the accompanying drawings.

Figure 1:
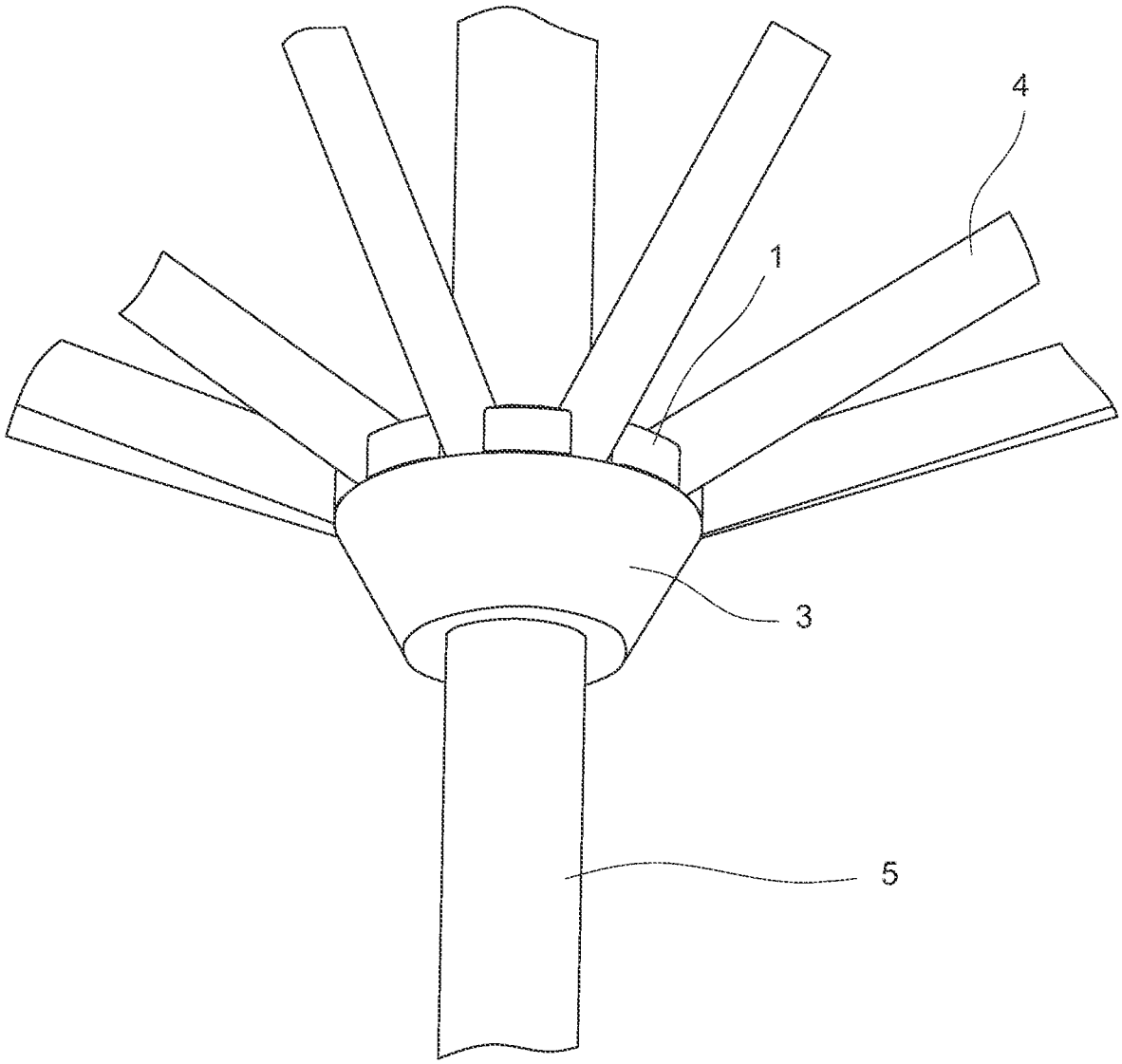
FIG. 1 is a perspective view of an umbrella nest assembly according to an embodiment of the present invention.
Figure 2:
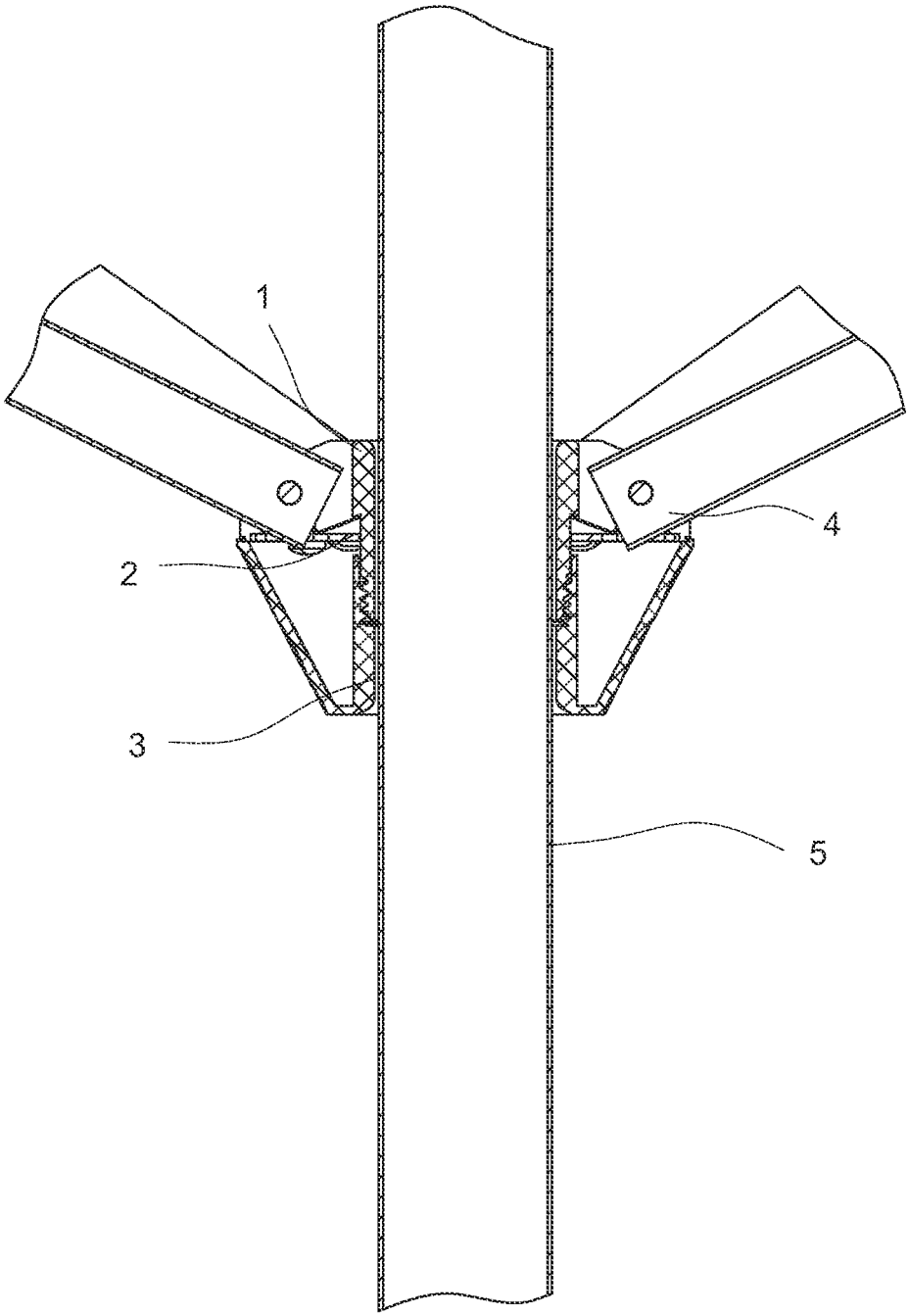
FIG. 2 is a longitudinal sectional view of FIG. 1.
Figure 3:
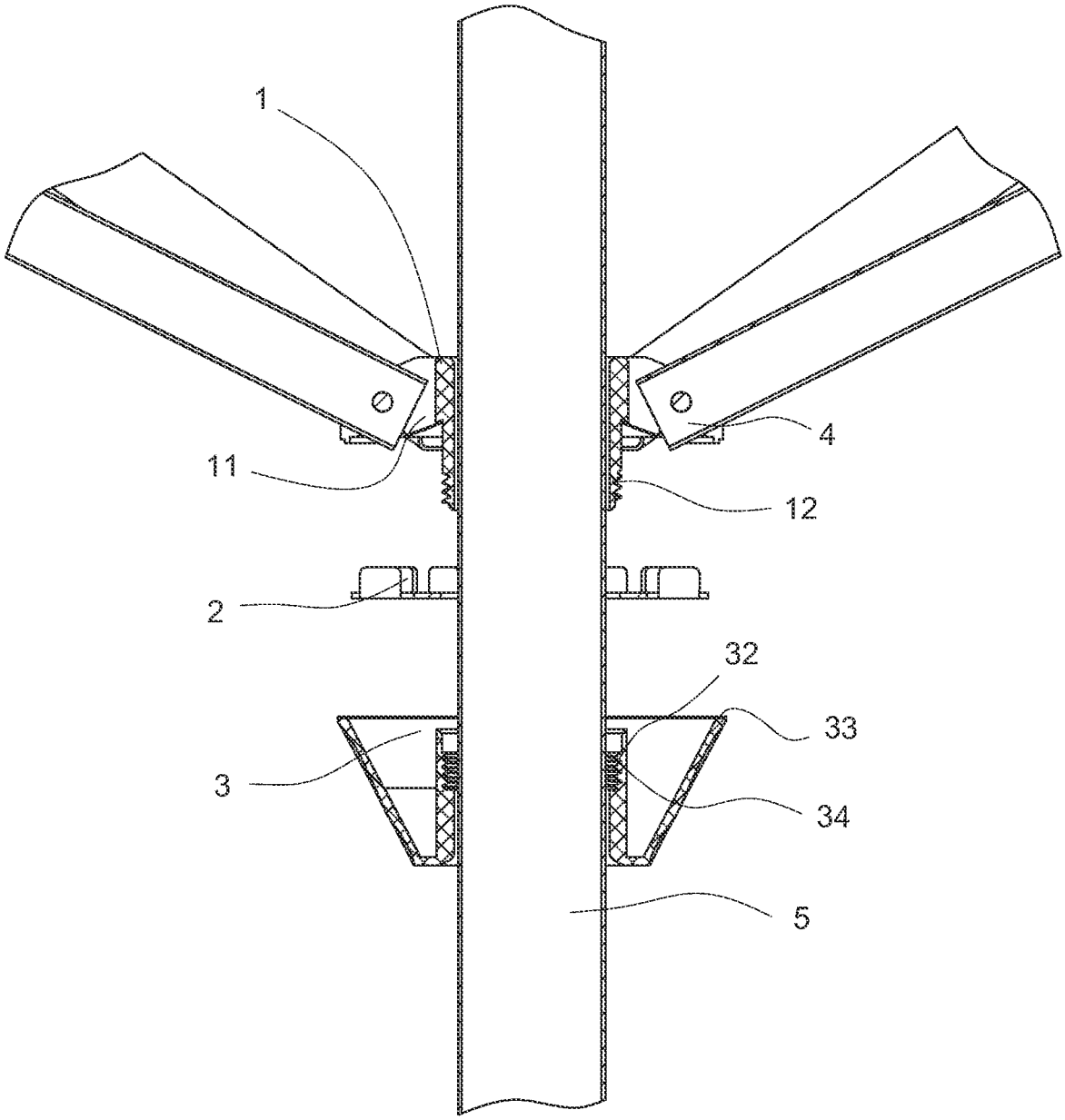
FIG. 3 is a view of FIG. 2 when the components apart along the middle column 5.
Figure 4:
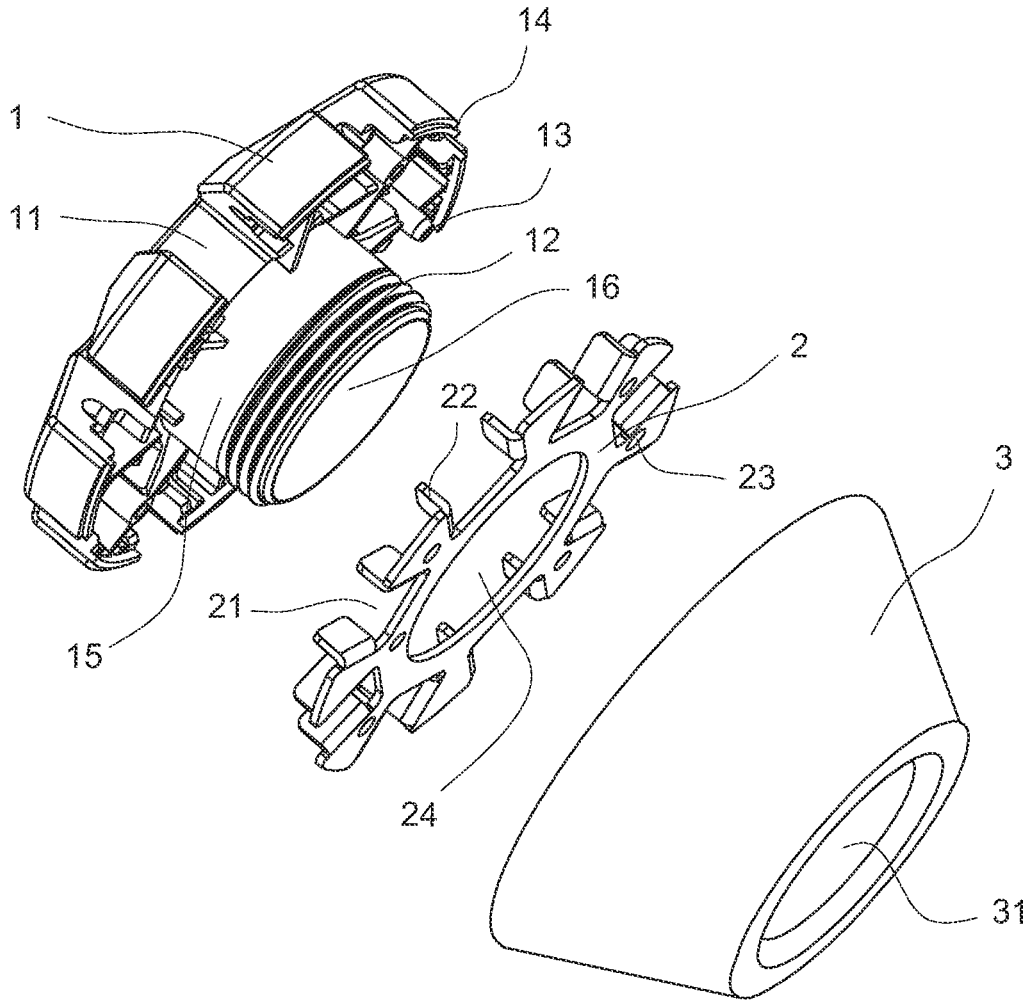
FIG. 4 is an exploded view of the nest assembly according to the embodiment of the present invention.

FIGS. 1-4 show a preferred embodiment of a rotary replaceable umbrella nest assembly for an umbrella according to the present invention. The umbrella comprises a middle column 5 and a plurality of rods 4 each having an end. The rotary replaceable umbrella nest assembly comprises a lower nest cover 1, a nest support 2 and a lower nest base ornament 3. The lower nest cover 1 has a plurality of recesses 11 for receiving the end of each rod 4, the lower nest cover 1 has a circular hole 16 at the center of the lower nest cover 1 for receiving the middle column 5; a connecting sleeve 15 fitted and connected to the lower nest base ornament 3 having a lower end extending down from the circular hole 16, and the connecting sleeve 15 has a plurality of external threads 12 on a lower end of the connecting sleeve 15. The nest support 2 has a ring-shape matching with a bottom of the lower nest cover 1 and is connected to the bottom surface of the lower nest cover 1. The nest support 2 is made of metal, and is a bearing carrier which serves as the lower nest base of traditional nests. The nest support 2 has a center hole 24 for the connecting sleeve 15 to pass through, and an outer edge of the nest support 2 corresponding to the recesses 11 of the lower nest cover 1 has a plurality of hollowed-out portions 21, and both sides of each hollowed-out portion 21 has a plurality of position pieces 22 inserted in the lower nest cover 1. The lower nest cover 1 has a plurality of stop flanges 14 facing down at a lower edge of the lower nest cover 1, and an outer diameter of the nest support 2 is matched with an inner diameter of the stop flanges 14; the nest support 2 has a plurality of connecting holes 23 disposed circumferentially and at intervals; the lower nest cover 1 has a plurality of connecting bars 13 corresponding to the connecting holes 23 at the lower end of the lower nest cover 1, and the nest support 2 and the lower nest cover 1 are closed up with each other and fixedly connected by the screws.

The lower nest base ornament 3 is an ornament which is made of plastic, disposed below the nest support 2, and threaded to the lower nest cover 1 such that the lower nest base ornament 3 is detachably connected to the lower nest cover 1. The lower nest base ornament 3 has a cone shape with a large upper end and a small lower end, the lower nest base ornament 3 has a through hole 31 at the center of the lower nest base ornament 3; a guide cylinder 34 for receiving the middle column 5 is connected to the lower nest base ornament 3; the guide cylinder 34 has a plurality of internal threads 32 on an inner wall at an upper end of the guide cylinder 34 matching to the external threads 12 of the connecting sleeve 15 of the lower nest cover 1; and the connecting sleeve 15 of the upper nest cover 1 is in threaded to the lower nest base ornament 3 after passing through the center hole 24 of the nest support 2. The lower nest base ornament 3 has an outer diameter that is the same as the lower nest cover 1; the lower nest base ornament 3 has a plurality of annular grooves 33 corresponding to the stop flanges 14 of the lower nest cover 1 at an upper edge of the lower nest base ornament 3; when the lower nest base ornament 3 is threaded to the lower nest cover 1, the stop flanges 14 of the lower nest cover 1 fits into the annular grooves 33 of the lower nest base ornament 3.

The nest is assembled by following steps.

The lower nest cover 1 and the nest support 2 are directly assembled and then fixed by screws after assembly, and the screws are concealed in the nest. The lower nest base ornament 3 is properly screwed into and connected to the lower nest cover 1 through threads. The lower nest base ornament 3 is replaceable.

In this embodiment, the lower nest assembly is connected to a frame by placing the lower nest cover 1 in place, putting the rods 4 in the lower nest cover 1, covering the nest support 2 on the lower nest cover 1 after all the rods 4 are put in, and tightening the screws. In this case, the frame can be unfolded and folded normally. The lower nest base decoration 3 is directly connected to the lower nest cover 1 through threads.

In this embodiment, the screws are concealed in the nest, and the lower nest base ornament 3 can be easily replaced, which can meet the requirements of replacing various types of exterior parts, and make the structure more aesthetic.

The protection scope of the present invention is not limited to each embodiments described in this description. Any changes and replacements made on the basis of the scope of the present invention patent and of the description shall be included in the scope of the present invention patent.

The invention claimed is:

1. A rotary replaceable umbrella nest assembly for an umbrella, the umbrella comprising a middle column and a plurality of rods each having an end;

the umbrella nest assembly comprising:

a lower nest cover;

a nest support disposed below the lower nest cover; and a lower nest base ornament disposed below the nest support;

wherein, the lower nest cover has a plurality of recesses for receiving the end of each rod, the lower nest cover has a circular hole at the center of the lower nest cover for receiving the middle column;

a connecting sleeve having a lower end extending down from the circular hole, and the connecting sleeve has a plurality of external threads on a lower end of the connecting sleeve;

the nest support has a ring-shape matching with a bottom of the lower nest cover, the nest support has a center hole for the connecting sleeve to pass through, the nest support is connected to the bottom surface of the lower nest cover surrounding the connecting sleeve;

the lower nest base ornament has an internal threaded hole matching with the external threads on the connecting sleeve, the lower nest base ornament is threaded to the lower nest cover such that the lower nest base ornament is detachably connected to the lower nest cover;

the lower nest base ornament has a cone shape with a large upper end and a small lower end, the lower nest base ornament has a through hole at the center of the lower nest base ornament;

a guide cylinder for receiving the middle column is connected to the lower nest base ornament;

the guide cylinder has a plurality of internal threads on an inner wall at an upper end of the guide cylinder matching to the external threads of the connecting sleeve of the lower nest cover;

the connecting sleeve of the upper nest cover is in threaded to the lower nest base ornament after passing through the center hole of the nest support; and an outer edge of the nest support corresponding to the recesses of the lower nest cover has a plurality of hollowed-out portions, and both sides of each hollowed-out portion have a plurality of position pieces inserted in the lower nest cover.

2. The umbrella nest assembly of claim 1, wherein the lower nest cover has a plurality of stop flanges facing down at a lower edge of the lower nest cover, and an outer diameter of the nest support is matched with an inner diameter of the stop flanges;

the nest support has a plurality of connecting holes disposed circumferentially and at intervals;

the lower nest cover has a plurality of connecting bars corresponding to the connecting holes at the lower end of the lower nest cover, and the nest support and the lower nest cover are closed up with each other and fixedly connected by the screws.

3. The umbrella nest assembly of claim 2, wherein the lower nest base ornament has an outer diameter that is the same as the lower nest cover;

the lower nest base ornament has a plurality of annular grooves corresponding to the stop flanges of the lower nest cover at an upper edge of the lower nest base ornament;

when the lower nest base ornament is threaded to the lower nest cover, the stop flanges of the lower nest cover fits into the annular grooves of the lower nest base ornament.

4. The umbrella nest assembly of claim 1, wherein the nest support is made of metal, and the lower nest base ornament is made of plastic.

* * * * *